US006095383A

United States Patent [19]

Smith

[11] Patent Number: 6,095,383

[45] Date of Patent: Aug. 1, 2000

[54] ADJUSTABLE MOLTEN METAL FEED SYSTEM

[75] Inventor: Dennis M. Smith, Crestline, Calif.

[73] Assignee: Fata Hunter, Inc., Riverside, Calif.

[21] Appl. No.: 09/183,185

[22] Filed: Oct. 30, 1998

Related U.S. Application Data

[60] Provisional application No. 60/063,897, Oct. 31, 1997.

[51] Int. Cl.[7] ..... B22D 41/08

[52] U.S. Cl. ..... 222/594; 266/80

[58] Field of Search ..... 222/590, 591, 222/594; 266/80, 99; 164/479, 480

[56] References Cited

U.S. PATENT DOCUMENTS

| | | | |
|---|---|---|---|
| 3,634,075 | 1/1972 | Hoff | 75/135 |
| 4,303,181 | 12/1981 | Lewis et al. | 222/591 |
| 4,407,679 | 10/1983 | Manzonelli et al. | 148/2 |
| 4,641,767 | 2/1987 | Smith | 222/591 |
| 4,928,748 | 5/1990 | Guthrie et al. | 164/479 |
| 5,178,205 | 1/1993 | Fukase et al. | 164/480 |
| 5,221,511 | 6/1993 | Fukase et al. | 266/45 |
| 5,238,049 | 8/1993 | Martin | 164/479 |
| 5,755,274 | 5/1998 | Maiwald et al. | 164/479 |

OTHER PUBLICATIONS

German Patent Abstract and drawing, Application No. DE 04306863, Filed Mar. 5, 1993, 2 pages.

*Primary Examiner*—Scott Kastler

*Attorney, Agent, or Firm*—Christie, Parker & Hale, LLP

[57] ABSTRACT

An improved molten metal feed system is provided for high speed, continuous casting of metals and alloys. The feed system includes a distributor box having an insulative lining which supports an internal flow distributor board. The flow distributor board includes a plurality of openings of various sizes and shapes spaced apart along the width of the board. The presence of the flow distributor board effectively separates the box into lower and upper sections and restricts the flow of liquid metal through the board and thus, forces entering liquid metal to fill the entire width of the distributor box below the flow distributor board. In addition, the liquid metal is stabilized across the width of the distributor box resulting in a balanced temperature gradient. Once the lower section of the distributor box is filled, the metal flows through the openings in the board into the upper section of the distributor box and into the feed tip nozzle. Flow dividers are also provided which are adapted to be positioned along the width of the distributor box. A baffleless feed tip nozzle is coupled to the distributor box. An adjustment mechanism is coupled to the feed tip nozzle which allows adjustment of the size of the feed tip opening.

18 Claims, 11 Drawing Sheets

FIG. 9
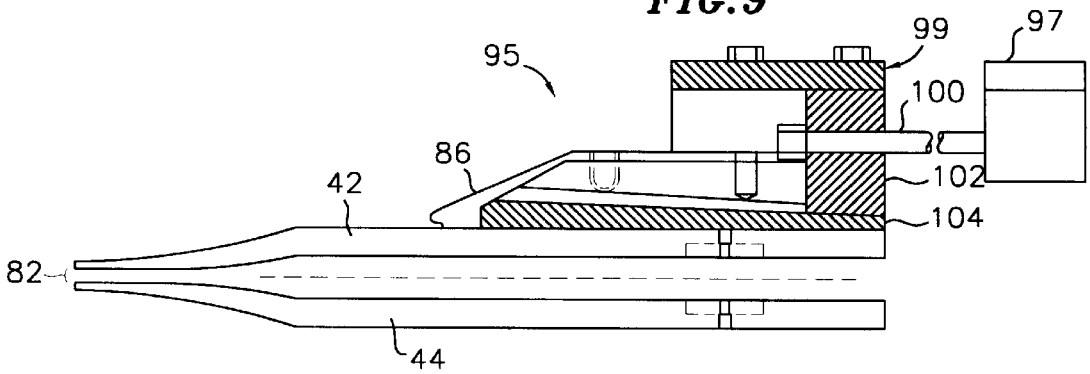
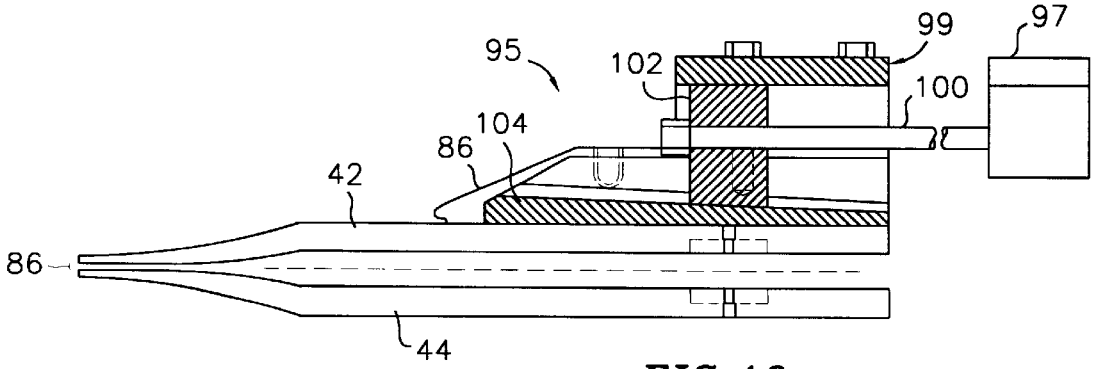
FIG. 10

ADJUSTABLE MOLTEN METAL FEED SYSTEM

CROSS-REFERENCE TO RELATED APPLICATIONS

This application claims the benefit of U.S. provisional patent application 60/063,897, filed Oct. 31, 1997, the contents of which are incorporated herein by this reference.

FIELD OF THE INVENTION

This invention relates generally to devices for the continuous casting of molten metals and more particularly, to an improved molten metal feed system and method for high productivity continuous casting.

BACKGROUND OF THE INVENTION

The formation and casting of metals and metal alloys of various kinds have been conducted for many years using commercial scale operations. For example, continuous twin roll casters, such as those shown in U.S. Pat. Nos. 2,790,216 and 4,054,173 are commonly used. The casters disclosed therein include an opposing pair of water cooled, counter-rotated and generally horizontally oriented casting rolls. Molten metal is routed through a feed system into the nip of the two rolls just prior to the closest approach of the rolls. Typically, the feed system includes an upstream head box and a feed tip nozzle. The metal is directed from the head box, through the feed tip nozzle and into the nip of the rolls. As the metal comes into contact with the water cooled casting rolls, heat is rapidly extracted and the metal begins to solidify. The solid metal is then compressed into a sheet as it passes through the gap between the caster rolls.

Conventional casting machines of this type are typically capable of producing 6 mm thick strips at productivity rates of approximately 1.7 tons/m width/hour. Recently, however, a new generation of casting machines has been developed for high speed, thin strip casting of molten metal. These new generation casters are capable of casting gauges of less than 1 mm. By developing the technology necessary to cast thinner and faster, it is possible to increase productivity and reduce the number of downstream rolling passes necessary. Specifically, this technology allows for great increases in productivity, greater casting capacity in addition to enhanced quality when compared with conventional casting machines.

In order to satisfy the more demanding requirements of this latest generation of casting machines, a need exits for an improved molten metal feed system. The feed systems currently being used on conventional casting machines have not been able to successfully handle the transition to higher production flow requirements. For example, the feed systems currently being used on conventional casting machines tend to produce uneven, and often turbulent flow through the feed tip nozzle when operated at increased speeds. This turbulence is caused by the presence of baffles, or spacers, within the feed tip nozzle. One or more baffles are typically incorporated along the width of the feed tip to help manipulate and direct the flow of molten metal through the tip. The use of such baffles is described in U.S. Pat. Nos. 4,303,181 and 4,641,767. Although this design has proven sufficient for conventional casting machines operating at nominal production rates, at increased speeds the presence of baffles in the feed tip produces eddy currents in the molten metal as it is being routed through the nozzle which in turn cause the flow to be turbulent.

Additionally, the feed systems currently in use with continuous casters tend to produce a large temperature gradient in the molten metal across the width of the strip. Prior to entering the feed tip nozzle, the molten metal travels through an upstream head box. Since the width of the head box is typically significantly less than the width of the feed tip nozzle, an uneven flow of molten metal may reach the feed tip. Specifically, molten metal may begin to flow through the center section of the feed tip nozzle before a sufficient amount of metal is present to begin flowing through the edges of the feed tip nozzle. Consequently, a temperature gradient is produced in the molten metal along the width of the feed tip nozzle where typically the temperature of the molten metal is greatest at the center of the feed tip nozzle. This temperature gradient affects the profile of the cast sheet.

These and other problems have been experienced when the existing feed system designs are used on machines operating in the high speed, thin gauge range. Many of the casting defects (e.g. buckling, starvation, etc.) experienced on the resulting cast sheet are due to these problems associated with the feed system design. Consequently, a need exists for a molten metal feed system for continuous casters capable of handling the more demanding requirements inherent in high speed, thin gauge casting.

SUMMARY OF THE INVENTION

The present invention, therefore, provides an improved molten metal feed system for continuous casters capable of handling the transition to the higher production requirements associated with high speed, thin gauge casting. Additionally, the molten metal feed system provided for by the present invention may be retrofitted for use with conventional casters, to significantly improve the productivity of conventional casters.

A baffleless feed tip nozzle is provided to eliminate the turbulence problems associated the presence of baffles in the feed tip. By eliminating the baffles it is possible for liquid metal flow to be introduced into the tip in a nonturbulent manner at rates sufficient enough to satisfy the increased production flow requirements. Additionally, the feed tip nozzle is adjustable in opening size to assist in the transition from conventional to thin gauge casting. The fixed tip opening of existing feed systems produces several problems during the transition from conventional to thin gauge casting. By removing the baffles from the nozzle, it is possible to provide the option of an adjustable feed tip opening.

A feed tip control system is provided with the adjustable feed tip to automatically adjust the size of the feed tip opening. In addition, a roll gap control system may also be provided for automatically adjusting the size of a roll gap between a pair of caster rolls downstream from the feed tip. This automatically adjusts the casters according to the feed tip opening size. A feed tip nozzle set-back control system is also provided to automatically adjusting a set-back of the feed tip nozzle from the caster rolls. The feed tip nozzle set-back control system is operatively coupled to either the feed tip control system or the roll gap control system for automatically adjusting the feed tip opening, the roll gap, and the set-back of the feed tip nozzle in relation to one another.

Upstream from the feed tip nozzle, a flow distributor board is provided along the width of the desired casting. The flow distributor board stabilizes and balance the metal flow before it passes into the downstream feed tip. The flow distributor board is housed within a distributor box between an upstream edge and a downstream edge. The flow distributor board generally separates the distributor box into a lower section and an upper section and is oriented generally transverse to the metal flow. The distributor box is insulated to prevent heat loss and may also include an insulated lid when casting larger widths. In addition, the distributor box is advantageously equipped with preheaters which further prevent heat loss.

As is conventionally known, molten metal is introduced into the lower portion of the distributor box from an upstream head box. As the liquid metal flows into the distributor box, it is forced to fill the entire width of the lower portion of the box due to the presence of the flow distributor board. More specifically, the molten metal is restricted to filling the width of the distributor box by a plurality of perforations spaced apart along the width of the flow distributor board. The perforations, including pores or channels of different shapes, sizes, and arrangement, hydrodynamically optimize the flow of the metal into the upper portion of the distributor box and into the feed tip. The metal permeates through the perforations along the flow distributor board at different rates depending on the pore or channel configuration. Therefore, it is possible to regulate the temperature gradient across the width of the cast sheet by stabilizing the flow of molten metal as it enters the feed tip nozzle.

Additionally, flow dividers are provided to permit the distributor box to be compartmentalized to form different effective widths. The flow dividers may be inserted into the upper portion of the distributor box, substantially transverse to the flow distributor board. It may be desirable to compartmentalize the distributor box in order to isolate different pore or channel configurations along the width of the flow distributor board. Therefore, the flow dividers may be used in concert with the flow distributor board to manipulate and/or balance the molten metal temperature gradient across the width of the feed tip nozzle. The ability to manipulate the metal flow and the temperature gradient across the effective full casting width may be used to alter and improve the strip profile of the resulting cast sheet.

BRIEF DESCRIPTION OF THE DRAWINGS

These and other features and advantages of the present invention will be appreciated as the same become better understood by reference to the following Detailed Description Of The Preferred Embodiments, when considered in connection with the accompanying drawings, wherein:

FIG. 9 is an enlarged cross sectional view of the feed tip nozzle of FIG. 1 and further showing an embodiment of a feed tip opening adjustment mechanism;

FIG. 10 is an enlarged cross sectional view of the feed tip nozzle of FIG. 9 shown with the feed tip opening minimized;

DETAILED DESCRIPTION OF THE PREFERRED EMBODIMENTS

Figure 1:
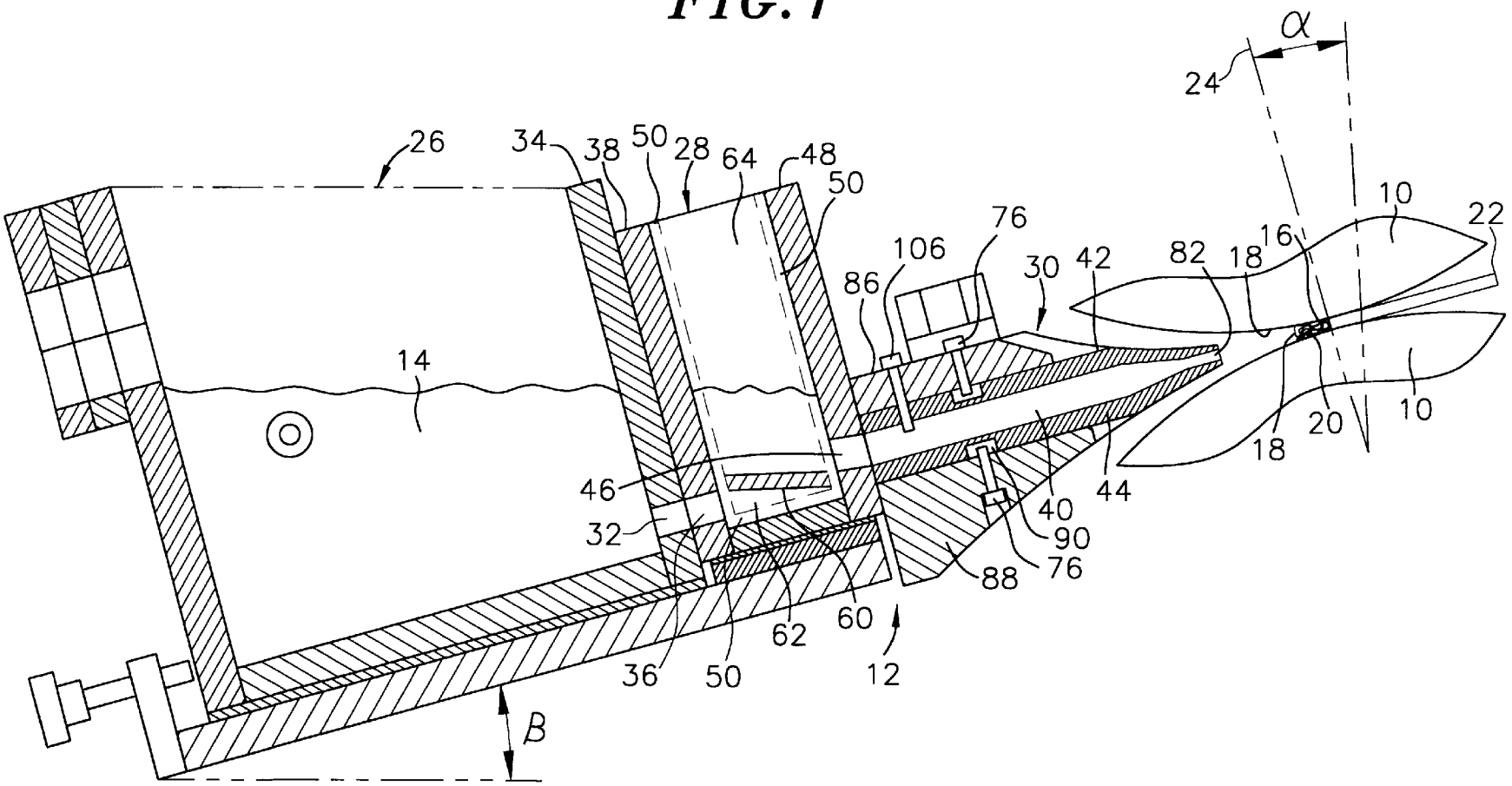
FIG. 1 is a cross-sectional view of a molten metal feed system for a continuous roll caster constructed according to the principles of the present invention.

FIG. 1 illustrates in transverse cross-section a pair of water cooled rolls 10 of a conventional roll caster. The rotational axes (not shown) of the two rolls 10 are parallel and the rolls are driven in the direction of movement of metal through the continuous caster (to the right in FIG. 1). The rolls 10 can be powered by any source, and preferably they are rotated independently by motors, such as by a pair of DC motors (not shown). The rolls 10 are cooled, usually by a cooling liquid passing through circumferential channels formed between a solid steel core and a cylindrical shell shrunk onto the core, to provide a heat sink for the molten metal as is common in the industry.

A molten metal feed system 12 of the present invention delivers fluid metal 14 into the space or bite between the rolls 10 to proceed toward the nip 16 of the rolls. The nip 16 is that location where the rolls 10 are closest together, also referred to as the roll gap. Thus, the fluid metal 14 emerges from the feed system 12 and engages a surface 18 of the rolls 10. Typically, the outer surfaces of the rolls 10 are cooled to provide a high heat transfer rate and produce rapid solidification of the metal 14. The final freezing point of the metal 14 is normally just before the nip 16 of the casting rolls 10. A frozen metal sheet 20 is thus formed continues through the gap between the rotating caster rolls 10. This process reduced the frozen metal sheet 20 in thickness and forms a strip of solid metal 22 which weaves the rolls 10 on the opposite side from the feed system 12.

In the illustrated embodiment, the feed system 12 is shown tilted upwardly at an angle β from horizontal or level, so that the metal 14 being cast travels slightly "up hill." Preferably, this angle is about 15 degrees. To accommodate the angled orientation of the feed system, a center line 24 through the caster rolls 10 is rotated a substantially matching angle from vertical. Alternatively, the feed system 12 may be oriented in a generally horizontal plane with the upper caster roll 10 directly above the lower roll. The molten metal feed system provided in the practice of this invention is suitable for use in almost any such orientation.

The present invention provides an improved feed system 12 particularly useful for continuous casting operations. The feed system 12 generally comprises a head box 26, an open distributor box or distribution box 28 adjacent to and downstream from the head box, and a feed tip nozzle 30 adjacent to and downstream from the distributor box. Molten metal is typically fed into the head box 26 from a holding furnace and transfer system (not shown) in which the metal alloy to be cast is maintained at the desired temperature. During casting, the metal 14 flows from the head box 26 into the distributor box 28 through an outlet 32 in a downstream edge 34 of the head box. A matching inlet 36 is located in an upstream edge 38 of the distributor box 28 for receiving the metal 14 from the head box 26. From the distributor box 28, the metal 14 flows through an outlet 46 in a downstream edge 48 of the distributor box into a feed path 40 between a pair of feed tip nozzle members 42, 44.

The feed system 12 provided for in the present invention further contains several unique features and advantages, including: a distributor box lined with an insulative layer and incorporating an internal heating element: a flow distributor board for stabilizing and balancing the flow of molten metal being introduced into the feed tip nozzle; flow dividers for isolating various flow patterns through the flow distributor board; a baffleless feed tip nozzle with an adjustable feed tip opening, and an automative system for adjusting the size of the feed tip nozzle opening. These features function integrally together to form an improved molten metal feed system for high speed, thin gauge continuous casting. Each of these features is discussed in more detail below.

Insulated Distributor Box

In a presently preferred embodiment, the distributor box 28 is constructed from a structural material capable of withstanding high temperatures and the harsh casting environment as is known to those of skill in the art in casting. For example, the head box 28 may be constructed from a hardboard material such as a high density ceramic fiber board material. A suitable hardboard is supplied by BNZ Corporation under the trade name "Marinite BNZ A" or alternatively "Marinite BNZ A HP." This hardboard has a density of about 65 pounds/cubic foot.

The distributor box 28 is then insulated with an insulating liner 50. As illustrated, the liner 50 may be directly attached to the interior wall of the distributor box 28 using a high temperature adhesive and fasteners such as screws. However, attachment may also be through, rivets, bolts, machined connections or any other devices or methods as known to those of skill in working with insulative materials and casting machinery.

Preferably, the entire interior of the distributor box 28 is lined, including the bottom. However, heat loss from the distributor box 28 may advantageously be reduced by placing the liner 50 along at least one wall. By providing an insulative liner 50 on at least a portion of the distributor box 28, the loss of heat from inside the box is reduced and operating efficiency and capacity is increased.

The insulative liner 50 comprises a material having a low thermal conductivity such as a low density board made from a ceramic fiber. This lower density board 50 does not have the mechanical strength of the hardboard but has a lower thermal conductivity and is thus, a better insulator. The low density board 50 preferably has a density of between about 10 pounds/cubic foot and about 30 pounds/cubic foot and more preferably, about 24 pounds/cubic foot. A suitable low density board 50 may, for example, be supplied by Western Industrial Ceramics, Inc. of California, under the trade name "MagnaBoard." However, other insulative liners or insulating materials 50 may be used.

Figure 2:
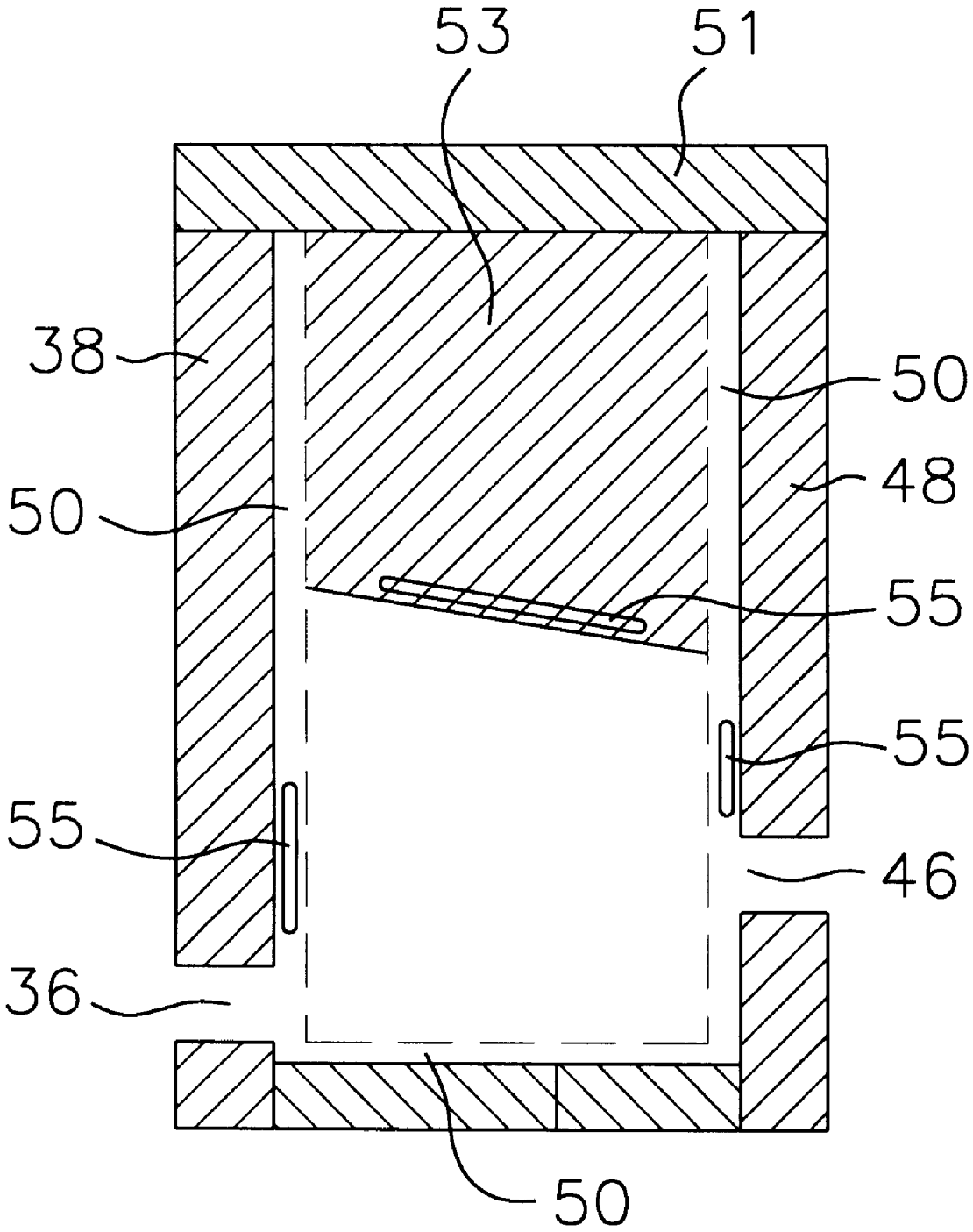
FIG. 2 is a cross-sectional view of an alternate embodiment of the distributor box of FIG. 1, wherein the distributor box is closed.

Referring now to FIG. 2, the distributor box 28 is shown equipped with a lid 51. This embodiment is preferable when casting larger widths and may be required when casting full widths at modern production speeds. More specifically, when casting widths of at least 48 inches, a closed distributor box 28, such as the box illustrated, is preferably used. However, a closed distributor box 28 may also be used for all continuous casting operations. When casting smaller widths, the lid 51 or other closed distributor box 28 is less necessary because less heat is lost.

As illustrated, the lid 51 is constructed in a similar fashion as the distributor box 28 and includes a hardboard portion and may also include an insulative liner portion 53. The insulative liner portion 53 preferably extends into the distribution box 28 to at least ensure contact with flowing molten metal during casting operations. However, the insulative liner 53 may also be partially submerged in the metal to ensure proper insulating. Similar to the liner 50, the lid liner 53 may also be constructed from a low density ceramic fiber board which is fastened to the structural hardboard portion.

The lid 51 may be coupled to the distribution box 28 in any number of ways. For example, the lid 51 may be screwed or latched to the distribution box 228. Alternatively, the lid 51 may include a wedge shaped portion formed from a step shaped hardboard which extends inwardly into the box 28 to form a wedge fit. A gasket, such as a compressible ceramic fiber blanket gasket may be placed between the lid 51 and the box 28 to further limit heat loss.

Distributor Box Heater

Referring now back to FIG. 1, the distributor box 28 is normally preheated in a low temperature oven at approximately 400° F. However, desiccated hot air may also be used as is commonly known. If the distributor box 28 is not properly preheated it can cause heat distribution problems and out gassing, by picking up inherent moisture from the distribution box assembly. In addition, the use of air only has proven generally insufficient for adequately preheating the distributor box 28 prior to start-up. Therefore, it would be desirable to also preheat the distributor box 28 prior to start-up.

Referring now to FIG. 2, the illustrated embodiment incorporates a heating element 55 for preheating the distributor box 28. As shown, the heating element 55 is an electrical heating element embedded within the insulative liner 50. The heating element 55 may also be attached to the inner or outer side of the liner 50 as is known to those of skill in the art. When using a distributor box 28 with a lid 51, the heating element is preferably embedded within the insulative portion 53. This may eliminate the need for heating elements 55 within the sides of the distributor box 28.

A preferred heating element 55 is an electrical heating member such as an electric wire type heater that is embedded within the insulative liner 53 just below the surface. The heating element 55 may be wire coils that are formed within the low density board 53 about ⅛ inch to ⅜ inches below the surface adjacent the molten metal. A suitable heating element 55, such as a 220V single phase or 340V variable adjustment coiled heater element may be obtained from Western Industrial Ceramic, Inc. of California. However, other heating element types, sizes and locations may also be suitable as will be known to those of skill in the art.

Prior to start-up, the heating element 55 may be activated to preheat the interior of the distributor box 28. Preferably, the distributor box 28 may be preheated to over 1,000° F. However, different preheat temperatures and durations may also be used depending upon casting and other conditions.

Flow Distributor Board

Figure 3:
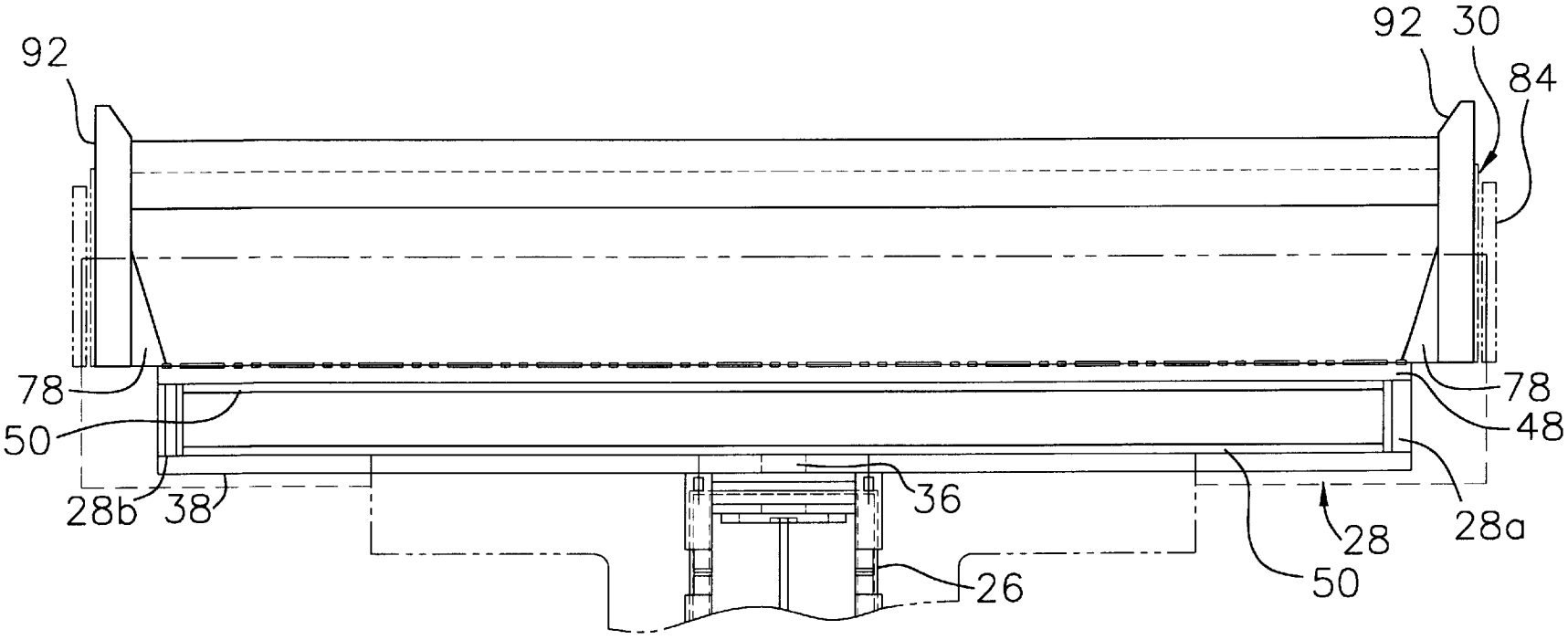
FIG. 3 is a top view of the molten metal feed system of FIG. 1.
Figure 4:
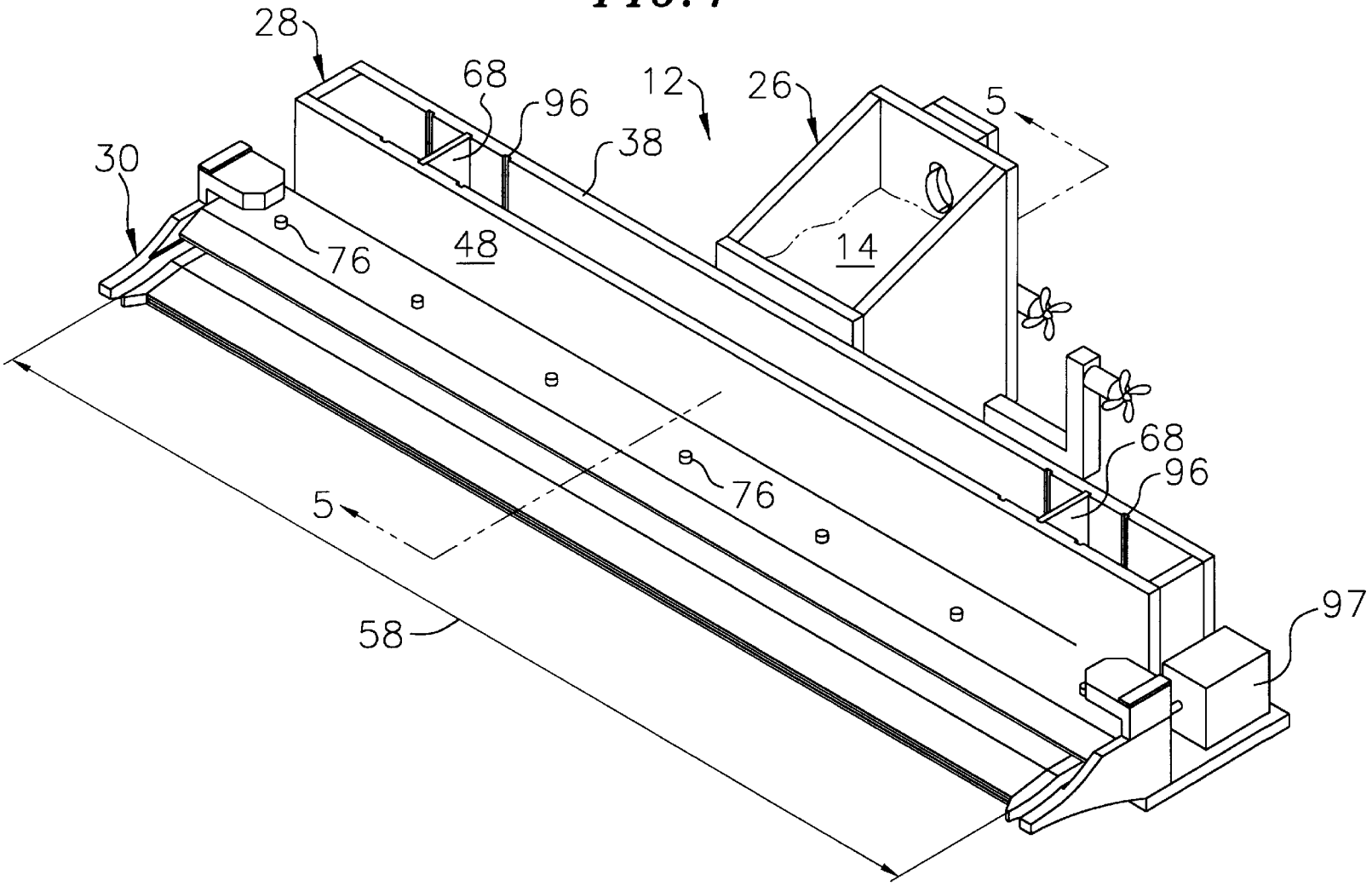
FIG. 4 is a perspective view of the feed system of FIG. 1.
Figure 5:
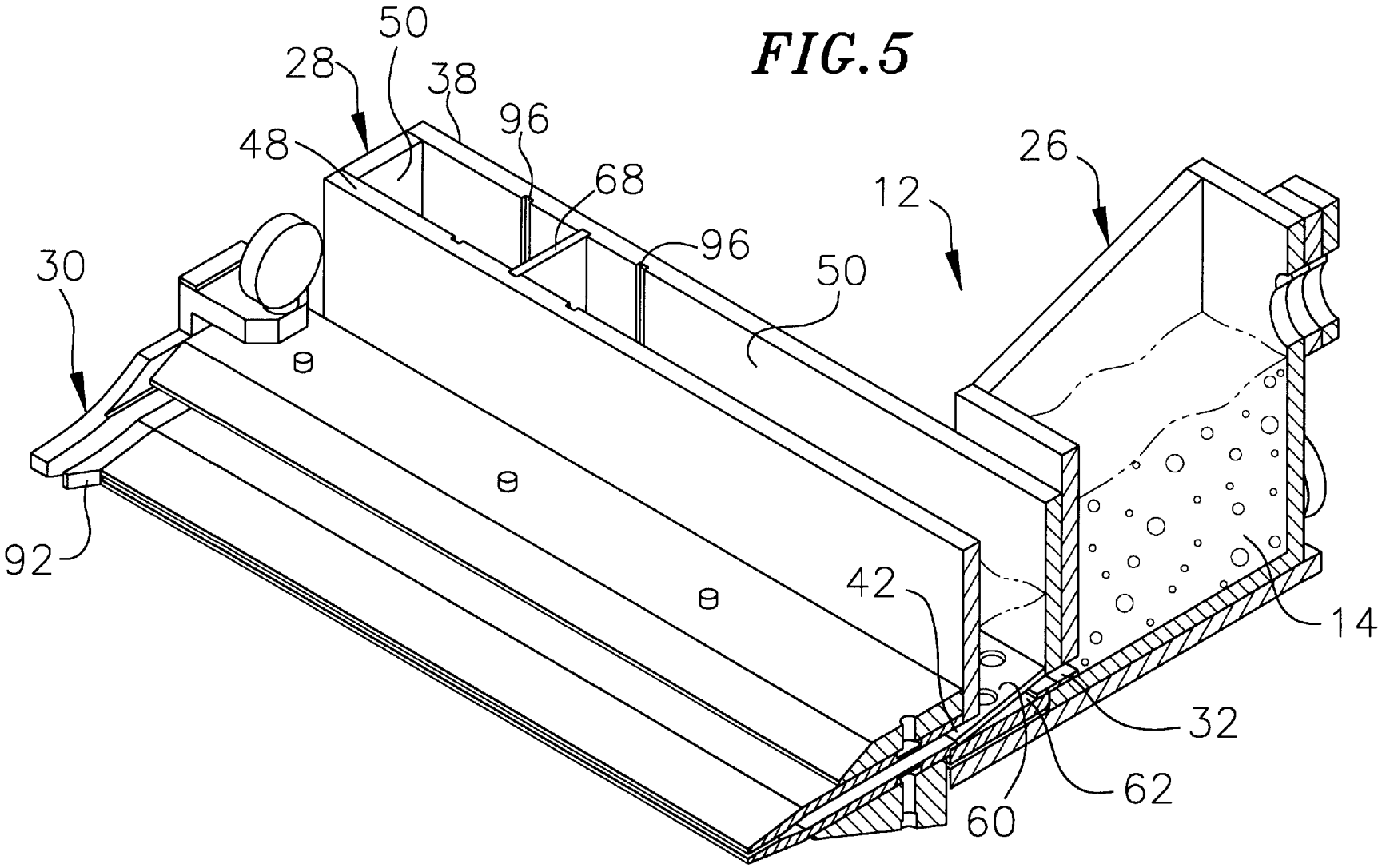
FIG. 5 is a partial cross-sectional view of the feed system of FIG. 4 taken along line 5—5.

As described above, existing feed system designs tend to produce a large temperature gradient in the molten metal across the width of the strip or casting, due primarily to the layout of existing feed systems. The relative dimensions of the components of the feed system are best illustrated in FIGS. 3 through 5. The feed tip nozzle 30 generally defines a full casting width 58 and the width of the distributor box 28 is substantially the same as the feed tip nozzle. However, the head box 26 and the outlet 32 in the head box through which the molten metal 14 is introduced to the downstream portion of the feed system, are significantly narrower.

In an exemplary embodiment of the present invention, an approximately one inch by three inch slot outlet 32 is provided in the downstream edge of the head box 26, through which the metal 14 flows into an approximately sixty-six inch wide distributor box 28. As previously described, the difference in dimensions of the adjacent components of the feed system may produce an uneven flow of metal 14 into the feed tip nozzle 30 and a temperature gradient across the casting width 58.

To minimize the flow differences and temperature gradients of the molten metal which flows from the distributor box 28 and into the feed tip nozzle, the present invention includes a flow distributor board 60 which is housed within the distributor box. The flow distributor board 60 is positioned between the upstream edge 38 and downstream edge 48 of the distributor box 28 and extends across an effective width of the box. Thus, the flow distributor board 60 defines a lower 62 and upper section 64 of the distributor box which effectively runs the entire length of the distributor box.

The flow distributor board 60 is positioned within the distributor box 28 to isolate the inlet 36 from the larger outlet 46. The inlet 36 in the upstream edge 38 of the distributor box 28 is located in the lower section 62 of the distributor box and the outlet 46 in the downstream edge of the distributor box is located in the upper section. The presence of the flow distributor board 60 in the distributor box 28 restricts the molten metal 14 flowing into the lower section 62 to fill across the entire width 58 of the distributor box before passing through the flow distributor board to enter the upper section 64 and into the feed tip nozzle 30.

Figure 6A:
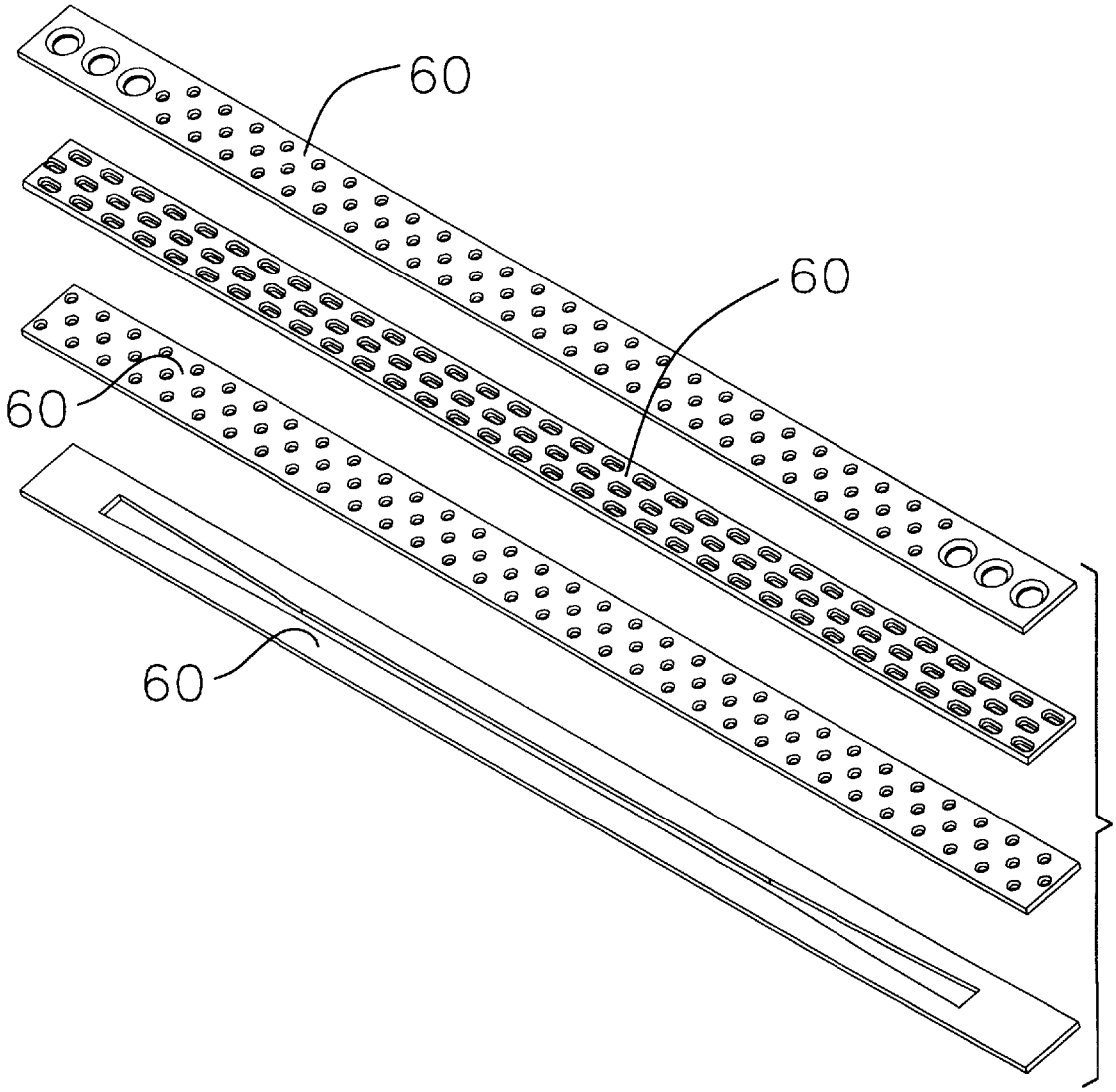
FIG. 6A is a perspective view of four exemplary flow distributor boards of the feed system of FIG. 1, each having a particular perforation or channel configuration.
Figure 6B:
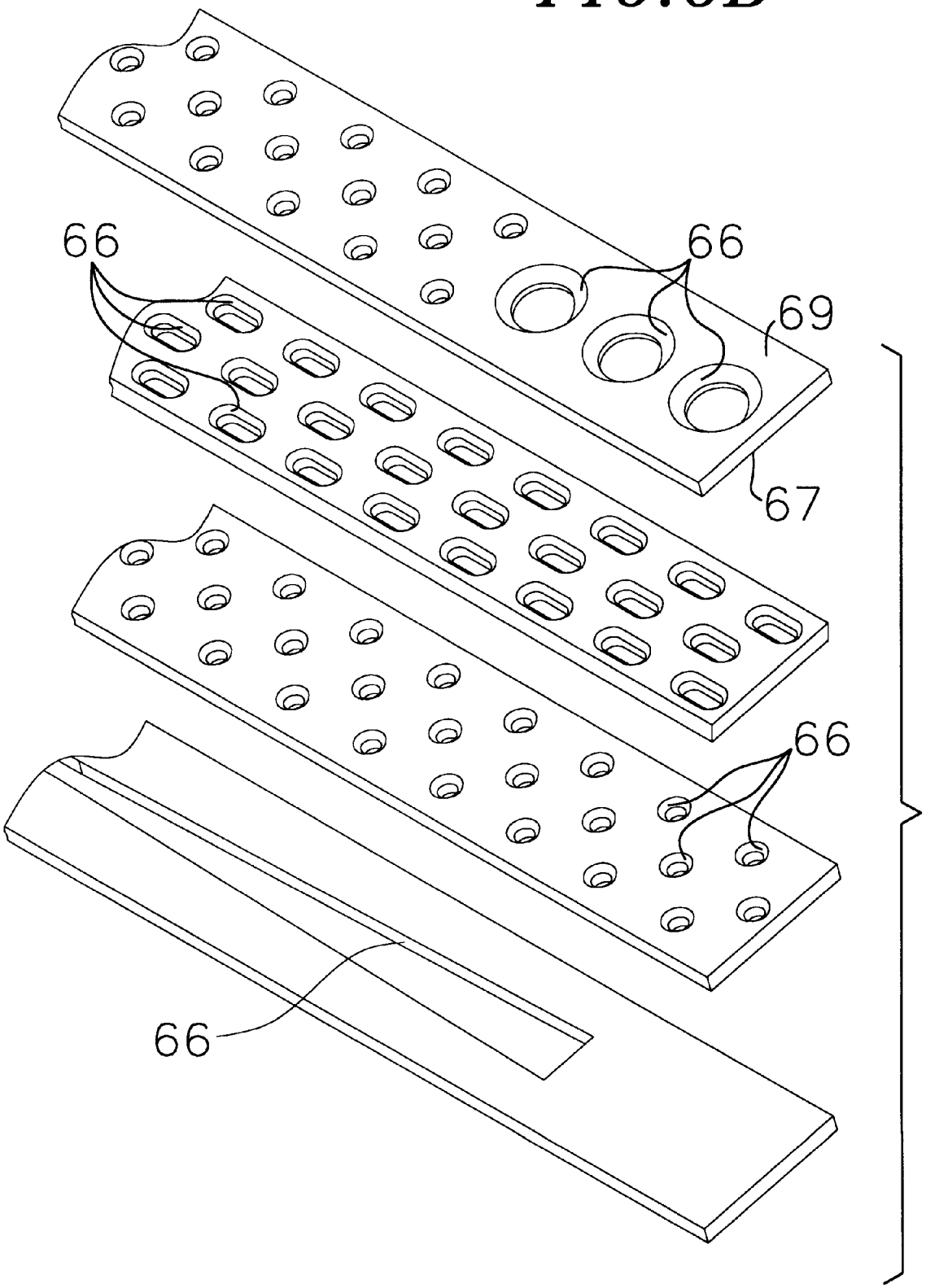
FIG. 6B is an enlarged partial view showing one end of the flow distributor boards of FIG. 6A.

A plurality of perforation or channels 66 are provided along the width of the distributor board 60 to permit metal flow into the feed tip nozzle 30. As can be seen in FIGS. 6A and 6B, the perforations 66 consist of a plurality of openings spaced apart across the width of the board 60. Alternatively, a single perforation, such as a channel 66 may be provided. Each of the perforations 66 passes from a lower surface 67 to an upper surface 69 to allow the molten metal 14 to pass therethrough.

Once the lower section 64 of the distributor box 28 has been filled, including across the entire width, the molten metal 14 in the lower section 62 of the distributor box is then forced upwards through the openings 66 in the flow distributor board 60 into the upper section 64 of the distributor box and into the feed tip nozzle 30. The result is a uniform, even flow of metal into the feed tip nozzle 30 across the entire width of the tip.

Those skilled in the art should realize that it is possible to manipulate the flow pattern, including volume, speed and thermal equilibrium, of the metal by varying the size, shape and arrangement (collectively "the configuration") of the perforations or channel(s) 66 in the flow distributor board 60. It may be desirable to use different perforations or channel configurations, spacings, etc., depending on the particular casting. For example, the particular casting speed, alloy, casting gauge and even the tip width of the casting operation may effect the desired configuration. Examples of various configurations are shown in FIGS. 6A and 6B. The examples shown are merely illustrative, however, and in any way limit the range of configurations that may be used to control and manipulate the metal flow with the present invention.

As mentioned above, the feed system 12 is preferably configured for tilt-up casting as best illustrated in FIG. 1. The flow distributor board 60 is preferably oriented within the distributor box 28 parallel to the horizontal, regardless of the orientation of the entire feed system 12. The flow distributor board 60 provided by the practice of the present invention, however, is suitable for use in other orientations.

In one embodiment., the flow distributor board 60 is wedged by a friction fit between the upstream and downstream edges 38 and 48 of the distributor box 28. More specifically, the flow distributor board 60 is wedged between the opposing insulative liners 50 attached to the opposing edges 38 and 48. A flow divider 68 or plurality of flow dividers may be used to help retain the distributor board 60 in the distributor box 28 during casting operations as will be described in greater detail below. However, any means well known in the art may be used to secure the distributor board 60 within the interior distributor box 28 to form the lower section 62 and the upper section 64.

Figure 7A:
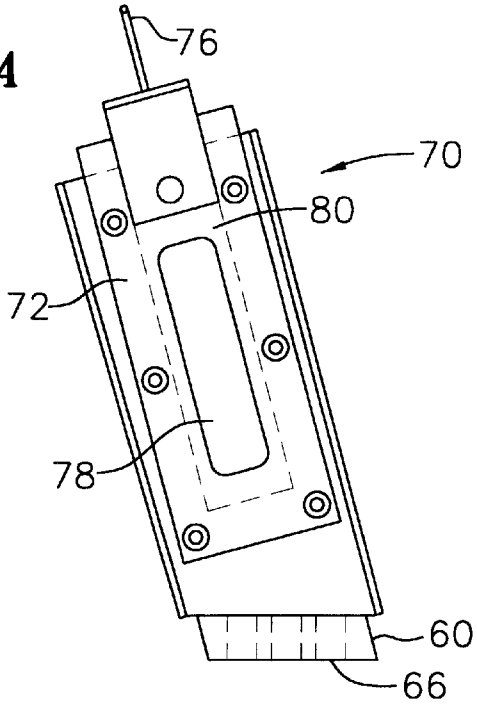
FIG. 7A is a side view of an embodiment of a cartridge assembly that may be used in connection with the molten metal feed system of FIG. 1.
Figure 7B:
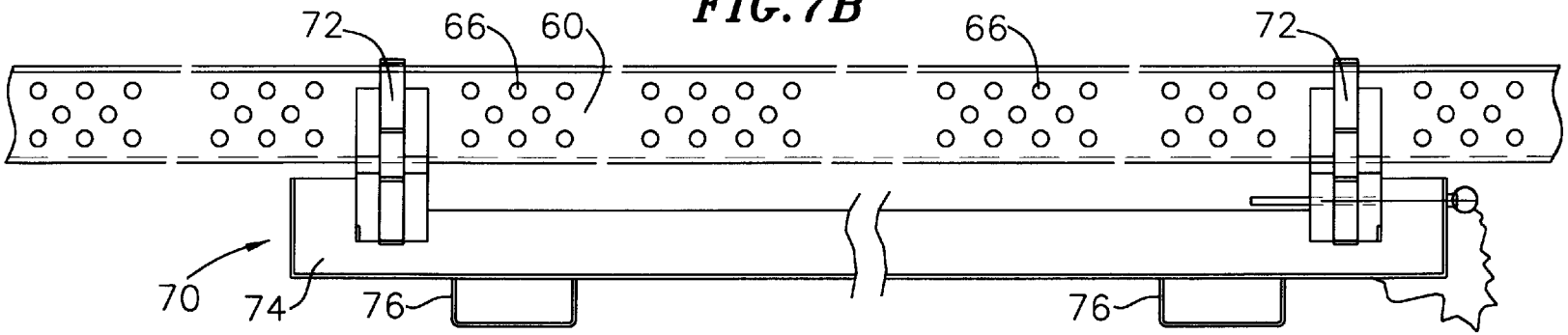
FIG. 7B is a top view of the cartridge assembly of FIG. 7A, with the support bar rotated to better illustrate the assembly.

One of the difficulties associated with the use of a flow distributor board 60 is the removal and insertion of the board in the distributor box 28, particularly during the casting operation. Therefore, in a presently preferred embodiment, a cartridge assembly 70 as best illustrated in FIGS. 7A and 7B is provided which includes the flow distributor board 60 coupled to a opposing and spaced apart vertical support units 72. In addition, a support bar 74 having handles 76 extends between the vertical support units 72.

The cartridge 70 is a removable assembly which is inserted or positioned into the distribution box 28, preferably just after start-up, and can be removed or reinserted into the box at any time during the casting operation.. The cartridge 70 may be changed or altered, including changing the flow distribution board 60, to modify the flow distribution. Different cartridges 70 may be used depending on the alloy, gauge, speed, and tip width of the casting process. By coupling the flow distributor board 60 to the handles 46 of the support bar 74, an easy method for safely removing or inserting the flow distributor board 60 is provided.

As illustrated, two vertical support units 72 are coupled to the upper surface 69 of the flow distributor board 60. The vertical support units 72 may be coupled to the flow distributor board 60 by any means well known in the art, such as by screws or other conventional fasteners. Those skilled in the art should realize that more or less vertical support units 72 may be alternatively utilized with the present invention.

The primary purpose of the vertical support units 72 is to facilitate the removal and insertion of the flow distributor board 60, and not to compartmentalize the distributor box 28. Therefore, the vertical support units 72 preferably include an aperture 78 that extends through the vertical support units so that molten metal flow through the upper section 64 of the distributor box 28 is not inhibited. However, the vertical support units 72 are preferably designed to receive an insert 80 to close of the aperture, such that each vertical support unit may also act as a flow divider, as described in more detail below. The inserts 80 may be inserted or removed from the vertical support units 72 at any time during the casting operation to control or manipulate the metal flow by compartmentalizing the distributor box 28, without affecting the operation of the remaining cartridge assembly 70.

To facilitate the control and manipulation of molten metal flow, different cartridge assemblies 70 having flow distributor boards 60 with different configurations are preferably available during the casting process. If a different molten metal flow is desired, the cartridge assembly 72 in the distributor box 28 can easily be removed using the handles 76 on the support bar 74, and a different cartridge assembly 70, having a flow distributor board 60 with the appropriate configuration for producing the desired molten metal flow, inserted into the distributor box without requiring stoppage of the casting process.

Baffleless Feed Tip Nozzle With an Adjustable Tip Opening

Referring now back to FIG. 1, the metal flow passes into the distributor box 28 and through the flow distributor board 60 prior to being introduced into the feed tip nozzle 30. The feed tip nozzle 30 is adjacent to and downstream from the distributor box 28 and comprises a pair of elongated feed tip members 42, 44, constituting, respectively the top and bottom members of the feed tip nozzle. The feed tip members 42, 44 are spaced apart defining the feed path 40 for the metal through the nozzle 30.

The feed path 40 is preferably aligned with the outlet 46 in the downstream edge 48 of the distributor box 28 for receiving the metal flow once it has permeated through the distributor board 60. The feed path 40 continues the length of the nozzle and concludes in a feed tip opening 82 having a total opening width corresponding approximately to the desired width of the sheet being cast.

Figure 8:
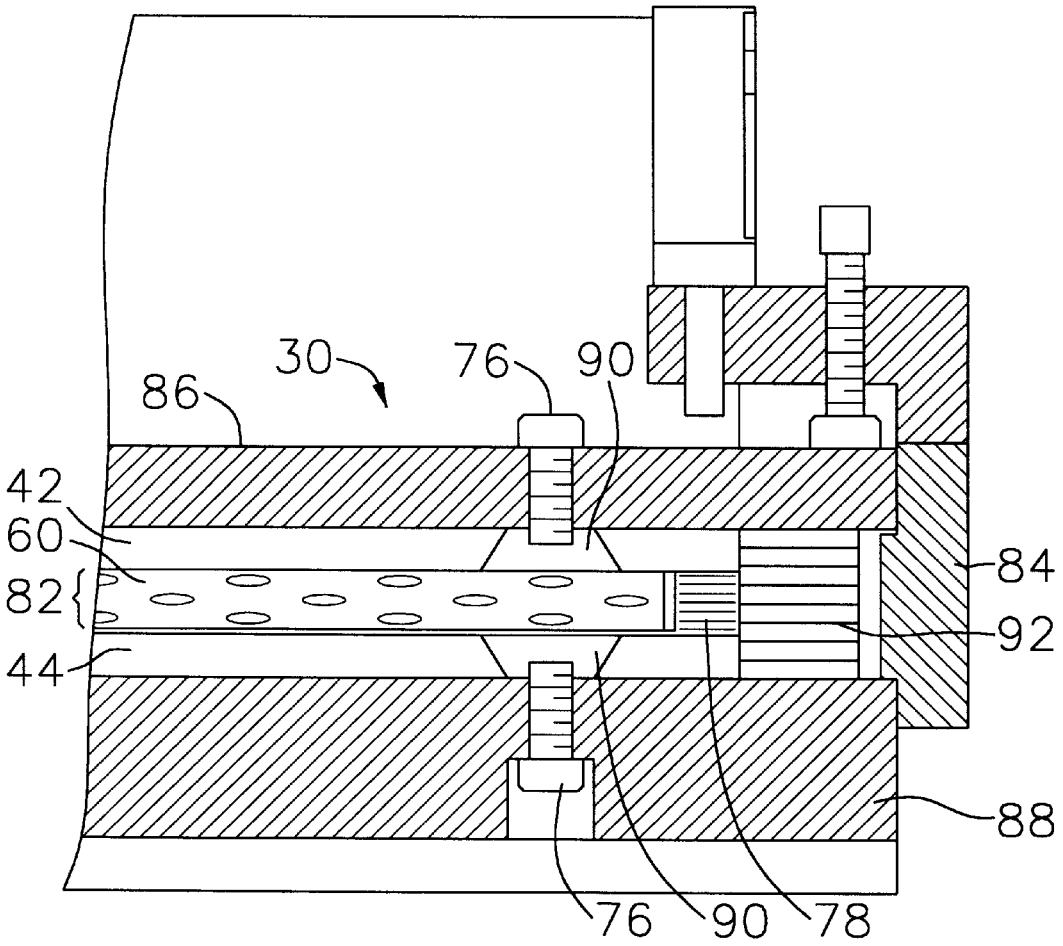
FIG. 8 is a partial front cross sectional view of the feed tip nozzle of FIG. 1.

Conventional end dams 92, as best shown in FIGS. 3 and 8, close off both ends of the feed tip nozzle 30 and help define the width of the sheet being cast. Preferably, the end dams 92 are made from a compressible gasket material such as a laminate fiber paper material as commonly used in casting operations. End plates 84 may be used to maintain the end dams in position and prevent the nozzle members 42, 44 from being closed together.

The width of a sheet prepared in a typical manufacturing operation can differ from time to time and the maximum casting width is dependent on the width of the caster rolls 10. A width of 1½ to 2 meters is common.

In a presently preferred embodiment, the feed tip nozzle members 42,44 are attached to a tip holder. The use of a tip holder may add needed rigidity and strength to the feed tip nozzle The tip holder comprises a top plate 86 and a bottom plate 88. A suitable top plate 86 may be constructed from a mild steel and a suitable bottom plate 88 from a meehanite casting for reduced warpage. However, other materials may be used as will be known to those of skill in the art of casting. The top feed tip nozzle member 42 is attached to the top tip holder plate 86 and the bottom feed tip nozzle member 44 is attached to the bottom tip holder plate 88.

The nozzle members 42, 44 may be attached to the tip holders 86, 88 by any means well known in the art. In the embodiment illustrated in FIG. 8, ceramic plugs 90 are attached to the respective tip plate 86, 88. Each plug 90 is threaded or otherwise adapted for attachment to a fastener 76 which couples each nozzle member 42, 44 to the respective tip holder 86, 88. To reduce cost, the plugs 90 may be through drilled and threaded with the base being filled with a moldable ceramic fiber bond to form a smooth flow path surface.

The feed tip nozzle 30 provided for in the present invention is a baffleless feed tip nozzle. The term "baffleless" refers to the absence of baffles or spacers in the nozzle between the feed tip members 42, 44. In contrast to most existing feed system designs, the feed path 40 is unobstructed by baffles for directing the flow of metal through the tip. Therefore, metal can be introduced to and directed through the tip 30 in a uniform, even flow at rates sufficient enough to satisfy the higher production flow requirements of high speed, thin gauge casting. In particular, no turbulence is experienced in the feed tip nozzle 30 despite the increased casting speeds.

Additionally, the feed tip nozzle 30 is adjustable, therefore providing nozzle orifice control. Specifically, it is possible to adjust the discharge gap or spacing 82 between the nozzle members 42, 44. The adjustable tip orifice option allows the discharge gap 82 to be made larger for conventional gauge and made smaller for thin gauge casting, resulting in greater control over the entire casting process Existing feed tip designs have a fixed tip opening which may cause problems during the transition from conventional to thin gauge casting (e.g. controlling the tip set-back, end dam failures, etc.). Thus, the baffleless feed tip design 30 allows the tip opening 82 to be adjustable during operation.

Referring now to FIG. 8, in conjunction with FIGS. 9 and 10, an embodiment of an automatic nozzle adjustment mechanism 95 for the feed tip opening 82 will be described. In particular, the nozzle gap or tip opening 82 is adjusted by moving the top tip holder plate 86 relative to the bottom tip holder plate 88. More specifically, a drive system 97 is coupled to the feed system 12 and adapted to adjust the position of the top tip holder plate 86 relative to the bottom plate 88 (reference FIG. 4). The drive system 97, which preferably includes a stepper motor and a gear reducer, is coupled to a mechanical system 99 which changes the relative position of the feed tip nozzle members 42,44, and thus, the size of the feed tip opening 82.

As illustrated in FIGS. 9 and 10, the drive system 97 is coupled to a shaft 100 which drives a male wedge 102. The male wedge 102 slidably engages a fixed tapered female slide 104 which is coupled to the top tip holder plate 86. The slide may be directly coupled to the upper tip holder plate 86. The wedges 102 and 104 are shaped (angled) such that by advancing the male wedge 102 forward it increases the size of the feed tip opening 82 likewise, the feed tip opening decreases 82 relatively as the drive system 99 withdraws the wedge. Mechanical stops may be provided to prevent blockage of the nozzle tip opening 82 or an inappropriately large tip opening.

Preferably, the automatic nozzle adjustment mechanism 95 comprises a pair of matched motor/gear reducer assemblies 97 and mechanical wedge assemblies 99 which operate together. As illustrated, each drive system 97 may be placed on either side of the distributor box 28 and the respective wedge assembly 99 adjacent the respective side of the nozzle 30. However, other automatic nozzle adjustment mechanisms may also be used as well as their placement relative to the feed system 12. The operation of the automatic nozzle adjustment mechanism 95 may also be automated and linked to a smart system with feedback control as will be further described below.

Adjustment of the feed tip opening 82 may also be manually operated and controlled, such as through acme type screws which forcibly move the tip holders 86 and 88 relative to each other or alternatively drive the wedge assembly as described above. In addition, gauges, such as dial gauges may be used to confirm and properly adjust the gap 82. However, any mechanical type system may be used to adjust the gap 82 as will be known to those of skill in the art.

Referring now, back to FIG. 3 in conjunction with FIG. 8, a compressible spacer gasket 78 is provided on each respective end of the distributor box 28. The spacer gaskets 78 prevent end dam 92 run off as well as nozzle tip 30 damage during the transition from conventional to thin gauge casting. The spacer gasket 78 transitions from the narrower distributor box 28 to the wider feed tip nozzle 30. The narrower distributor box 28 is used to provide a support location for the feed tip nozzle adjustment mechanism 97. The compressible spacer gaskets 78 are preferably sections cut from a high temperature fiber paper, such as a laminate ceramic fiber paper gasket. However, other sealing materials may also be used as will be known to those of skill in the art.

Figure 11:
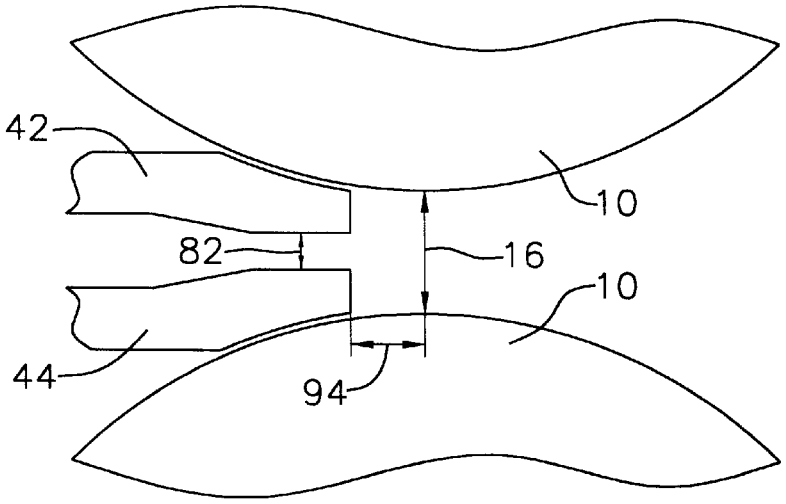
FIG. 11 is side view schematically illustrating the relationship between the gap control system, tip positioning system, and tip nozzle orifice control.

Referring now to FIG. 11, conventional roll casters typically have a roll gap control system and a feed tip positioning system that work independently from one another. The roll gap control system permits adjusting the roll gap 16 (increasing the gap for higher gauges and decreasing the gap for lower gauges) at any time during the continuous casting operation. The feed tip positioning system permits adjusting the position of the feed tip nozzle, tip set-back 94 (moving if forward into the roll gap or moving backward out of the roll gap) at any time during the continuous casting operation.

In order to more accurately control the metal flow output during casting for any consistency, it would be advantageous to automate the control of the roll gap 16, tip set-back 94, and the size of the gap or spacing in the feed tip orifice 82, such that the roll gap 16 would be the master variable, and the tip positioning and orifice size control would be the followers. In other words, the tip positioning and orifice control adjustment features of the caster system are electronically tied or looped, using a programmable logic controller (PLC) or other suitable means, to the roll gap control such that they automatically respond when a specific roll gap 16 is set. As a result, the roll gap 16, tip set-back 94, and feed tip orifice size 82 can be controlled independent of one another, or automatically in relation to one another. Such an automation feature will facilitate more precise control and repeatability in the casting process, which is necessary for optimum performance.

For example, referring to FIG. 11, if the roll gap 16 is reduced from 0.230 inches to 0.177 inches, then the tip set-back 94 of 2.250 inches and the feed tip orifice 82 of 0.270 inches would change either proportionately, or as programmed to allow for the required clearance. If this change is not made, the feed tip nozzle 30 could be broken as the rollers 10 close to decrease the roll gap 16. If the roll gap 16 is reduced from 0.230 inches to 0.177 inches, but it is desired to maintain the same tip set-back 94 of 2.250 inches, then a feed tip 82 orifice change from 0.270 inches to 0.217 inches could be programmed to allow for the required clearance. Alternatively, if it is desired to maintain the tip 82 orifice at 0.270 inches as the roll gap 16 is reduced to 0.177 inches, then a tip set-back 94 change from 2.250 inches to 2.470 inches could be programmed to allow for the required clearance.

Those skilled in the art will realize that the precise relationship between the roll gap 16, tip set-back 94, and feed tip orifice size 82 will depend on a variety of parameters, including but not limited to: the alloy being cast, strip quality, extrusion requirement and maximum flow rate. Depending on the exact parameters, it may be desirable to adjust only the tip set-back 94, only the feed tip orifice 82, or both the tip set-back and the feed tip orifice.

Flow Dividers

In a presently preferred embodiment, flow dividers 68 are provided for controlling and manipulating the metal flow by compartmentalizing the distributor box 28 as best illustrated in FIGS. 4 and 5. This may be particularly desirable when different pore or channel configurations 66 are present along the width of the flow distributor board 60 (best shown in FIG. 6B). The flow dividers 68 may be used to isolate the different perforation or channel configurations 66 on the distributor board 60 to prevent the mixing of the flow from the different configurations, to regulate the different flow rates, and to achieve a uniform temperature across the width of the distributor box 28 and thus, the feed nozzle tip 30. It is a particular advantage of the flow dividers 68 that they allow the temperature gradient between compartments to be manipulated along the width of the flow distributor board 60 allowing the capability to alter the strip profile.

The flow dividers 68 are inserted into the distributor box 28 between the upstream 38 and downstream 48 edges of the distributor box, substantially transverse to the flow distributor board 60. Adjustment slots 96 may be formed in the upstream and downstream edges of the distributor box for receiving the flow dividers 68. Preferably, these adjustment slots are cut or otherwise formed within the insulative liner 50. The flow dividers 68 are preferably shaped to match the cross section of the upper section 64 of the distributor box 28 and thus, prevent flow and define the effective width of the distributor box.

Figure 12:
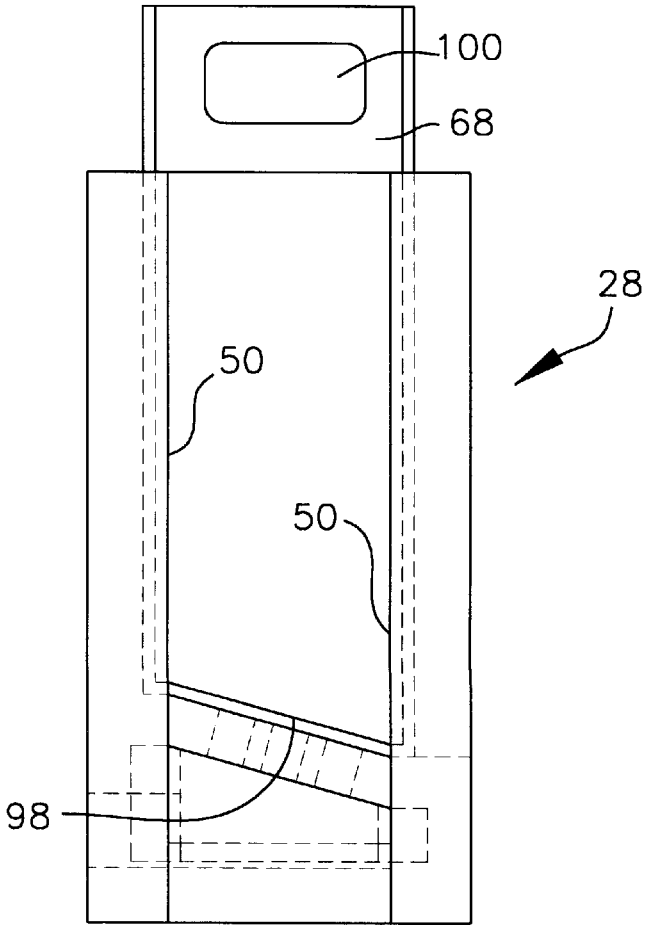
FIG. 12 is a side view of the distributor box of the feed system of FIG. 1 with flow dividers.

In the embodiment illustrated in FIG. 1 where the feed system 12 is oriented for "tilt-up" casting, a bottom edge 98 of the flow dividers 68 may need to be angled accordingly, as illustrated in FIG. 12. For example, the bottom edge 98 should be angled to match the "tilt up angle." It should be noted, however, that a variety of different shapes may be used for the flow dividers 68 of the present invention and the shape of the dividers will largely be dictated by the configuration of the feed system 12, including the distribution box 28, the alloy being cast, and the casting speed and width. Moreover, it should be realized that the desired flow pattern and the configuration of perforations 66 in the flow distributor board 60 may dictate the desired number and location of flow dividers 68. Therefore, although FIG. 4 illustrates the use of two flow dividers 68, the feed system 12 provided according to the principles of the present invention contemplates the use of more or less flow dividers as required Likewise, although the flow dividers 68 illustrated in FIG. 4 are oriented substantially perpendicular to the edges 38, 48 of the distributor box 28, in an alternate embodiment of the present invention, the flow dividers 68 may be angled relative to the edges of the distributor box.

With reference to FIG. 12, a handle 100 may be provided at a top edge of the flow dividers 68 to assist in the safe installation and removal of the board from the distributor box 28. As shown, the handle 100 may extend beyond the open upper surface of the distributor box 28 to allow for easy installation and maintenance of the flow distributor boards 60.

As described above, when the cartridge assembly 70 illustrated in FIGS. 7A and 7B is utilized with the present invention, inserts 80 may be inserted into the vertical support units 72 so that the vertical support units act as flow dividers 68. Additional flow dividers 68 may be used in connection with the cartridge assembly 70 if necessary to provide a desired compartmentalization of the distributor box 28.

Feed System Operation

An embodiment of operation of the feed system 12 provided. for in the present invention and generally illustrated in FIG. 1, when used in a continuous casting operation will be described. The feed system 12 is preheated, preferably in an oven. The feed system 12 is removed from the oven or other preheater and the distributor box 28 is further preheated using the heating elements 55. After sufficient preheat temperature is attained, molten metal 14 is allowed to flow into the lower section 62 of the distributor box 28 through the outlet 32 in the upstream headbox 26. The presence of the flow distributor board 60 in the distributor box 28 restricts the flow of the molten metal 14 and forces the flow to fill the entire width of the distributor box before rising upward through the openings 66 in the flow distributor board 60 and into the upper section 64 of the distributor box.

The insulative lining 50 within the distributor box 28 prevents massive heat loss and cooling of the molten metal. The lid assembly 51 and attached liner 53 further prevent this heat loss from the molten metal 14 out of the box 28.

After filling the lower section 62 of the distributor box 28, the metal 14 flows through the perforations 66 into the upper section 64 of the box and then into the feed tip nozzle 30. Through this process, the flow distributor board 60 helps stabilize and balance the metal flow along the entire effective casting width 58.

As previously described, different perforation sizes, configurations and spacings or alternatively channel configuration 66 may be used depending on the particular speed and gauge of the casting operation. When necessary, the cartridge assembly 70 may be removed and replaced with a different cartridge assembly having a flow distributor board 60 with a different perforation or channel configuration 66.

A temperature measuring device 104 is used to measure the temperature of the molten metal 14 which passes out of the distributor box 28 and through the feed tip nozzle 30. Preferably, this temperature measuring device 104 comprises a plurality of thermocouples which extend into the flow path and provide feedback regarding the temperature of the molten metal. The thermocouples 104 are spaced apart across the casting width 58 to indicate whether the temperature gradient across the casting width is as desired. Thus, the thermocouples 104, which may, for example, be five identical thermocouples spaced apart on approximately 17 inch centers, indicate whether the cartridge 70 and particularly, the flow distribution board 60 is stabilizing the flow and temperature gradient properly and whether is should be replaced with a flow distributor board having a different configuration of perforations.

In the illustrated embodiment, the thermocouples are embedded into the upper tip plate 86 and extend through the upper nozzle member 42 and into the metal flow path 40 approximately ¼ inch. The thermocouples are too small to create turbulence or eddie currents. The thermocouples 104 are run back to a computer or data logger (not shown) on a substantially continuous basis to allow constant monitoring of the flow temperature gradient across the casting width 58. As will be known to those of skill in the art, other temperature measuring devices and methods may also be used to achieve similar or otherwise acceptable feedback information on the temperature gradient across the casting width 58.

Flow dividers 68 may be inserted into the distributor box 28 to compartmentalize and define an effective width of the box and to isolate different configurations on the flow distributor board 60. Use of the flow dividers 68 permits manipulation of the metal flow across the entire casting width 58 to allow, for example, altering the temperature gradient affecting the strip profile during operation. From the distributor box 28, the metal flow is introduced into the feed path 40 of the feed tip nozzle 30.

The feed tip nozzle 30 is baffleless which allows for a uniform, even flow of metal through the feed tip despite increases in casting speeds. Moreover, the tip opening 82 of the nozzle 30 is adjustable so that it may be increased or decreased during the transitions between conventional to thin gauge casting. Furthermore, the control of the roll gap 16, tip set-back 94, and feed tip opening 82 may be automated using motorized systems under computer control. Further, these control systems may be linked for synchronous and more efficient operation.

While various embodiments of this invention have been shown and described, it would be apparent to those skilled in the art that many more modifications are possible without departing from the inventive concepts herein. For example, although the feed system of the present invention has been primarily described for use in high speed, thin gauge continuous casters, it should be realized that the feed system disclosed herein may be retrofitted for use with conventional casters. Even at nominal production rates, the improved feed system will significantly improve the productivity of conventional casters. It is, therefore, to be understood that within the scope of the appended claims, this invention may be practiced otherwise than as specifically described.

What is claimed is:

1. A feed system for use in continuous casting of a molten metal, the feed system comprising:

a distributor box having a flow length and a width, the distributor box having an insulative liner along at least one inner surface to reduce heat loss;

a flow distributor board housed within the distributor box between an upstream and a downstream edge to define an upper and a lower section of the distributor box, the flow distributor board including at least one perforation communicating between the upper and lower sections;

a feed tip nozzle downstream from the distributor box, the nozzle including a pair of feed tip nozzle members spaced apart to define a feed tip opening at a downstream edge of the feed system;

at least one flow divider, substantially transverse to the flow distributor board, within the upper section of the distributor box for compartmentalizing and defining an effective width of the distributor box; and wherein, during casting, a flow of the molten metal fills substantially the width of the lower section of the distributor box before flowing upward through the perforation in the distributor board and into the feed tip nozzle.

2. The feed system according to claim 1 wherein the perforation in the flow distributor board is sized and configured to restrict at least a portion the molten metal which flows upward through the at least one perforation and into the feed tip nozzle.

3. The feed system according to claim 1 wherein the at least one perforation in the flow distributor board comprises a plurality of openings spaced apart along the width of the flow distributor board.

4. The feed system according to claim 1 wherein the perforation in the flow distributor board comprises a channel extending substantially across the width of the flow distributor board.

5. The feed system according to claim 1 wherein the upstream and downstream edges of the distributor box contain a plurality of pairs of opposing adjustment slots, each opposing pair adapted for receiving a flow divider.

6. The feed system according to claim 1 wherein the insulative liner within the distributor box comprises a low density liner which substantially covers the entire inner surface of the distributor box in contact with the molten metal.

7. The feed system according to claim 6, and further comprising a cover having an insulative liner for covering the distributor box and reducing heat loss.

8. The feed system according to claim 1 wherein the insulative liner comprises a low density ceramic fiber board.

9. The feed system according to claim 1, and further comprising a heating element mounted within the distributor box.

10. The feed system according to claim 9 wherein the heating element comprises an electric heater element embedded within the insulative liner mounted within the distributor box.

11. The feed system according to claim 1 wherein the spacing between the feed tip members is adjustable.

12. The feed system according to claim 11, and further comprising:

a feed tip control system for automatically adjusting the space between the feed tip members; and a roll gap control system for automatically adjusting the size of a roll gap between a pair of downstream caster rolls, wherein the feed tip control system is operatively coupled to the roll gap control system for automatically adjusting the size of the feed tip opening and roll gap in relation to one another.

13. The feed system according to claim 12, and further comprising:

a feed tip nozzle set-back control system for automatically adjusting a set-back of the feed tip nozzle from the caster rolls, wherein the feed tip nozzle set-back control system is operatively coupled to either the feed tip control system or the roll gap control system for automatically adjusting the size of the feed tip opening, the roll gap, and the set-back of the feed tip nozzle in relation to one another.

14. The feed system according to claim 1, and further comprising a pair of vertical support units coupled to the flow distributor board to form a cartridge assembly, and a support bar having a handle extending between the vertical support units to facilitate removal of the cartridge assembly from the distributor box.

15. The feed system according to claim 14, and further comprising at least one insert, substantially transverse to the flow distributor board, within the upper section of the distributor box, and wherein each of the vertical support units comprises a slot for receiving the at least one insert, such that vertical support units act as a flow divider to compartmentalize the distributor box.

16. A feed system for use in continuous casting, the feed system comprising:

an adjustable feed tip nozzle including a pair of feed tip nozzle members spaced apart to define a feed tip opening at a downstream edge of the feed system;

a feed tip control system for automatically adjusting the size of the feed tip opening; and a roll gap control system for automatically adjusting the size of a roll cap between a pair of caster rolls, wherein the feed tip control system is operatively coupled to the roll gap control system for automatically adjusting the feed tip opening and roll gap in relation to one another.

17. The feed system according to claim 16, and further comprising:

a feed tip nozzle set-back control system for automatically adjusting a set-back of the feed tip nozzle from the rolls, wherein the feed tip nozzle set-back control system is operatively coupled to either the feed tip control system or the roll gap control system for automatically adjusting the feed tip opening, the roll gap, and the set-back of the feed tip nozzle in relation to one another.

18. The feed tip nozzle according to claim 16 wherein the feed tip nozzle is baffleless.

* * * * *